US011382466B1

(12) United States Patent
Anderson et al.

(10) Patent No.: US 11,382,466 B1
(45) Date of Patent: Jul. 12, 2022

(54) ACTIVE FLOW FACIAL CLEANSER

(71) Applicants: Eric Anderson, Palos Verdes Estates, CA (US); Vincent Sorrentino, Alpine, CA (US)

(72) Inventors: Eric Anderson, Palos Verdes Estates, CA (US); Vincent Sorrentino, Alpine, CA (US)

( * ) Notice: Subject to any disclaimer, the term of this patent is extended or adjusted under 35 U.S.C. 154(b) by 0 days.

(21) Appl. No.: 17/387,649

(22) Filed: Jul. 28, 2021

(51) Int. Cl.

| | |
|---|---|
| ***A47K 7/04*** | (2006.01) |
| ***B08B 3/02*** | (2006.01) |
| ***B08B 5/04*** | (2006.01) |
| ***B08B 3/10*** | (2006.01) |

(52) U.S. Cl.
CPC ..... *A47K 7/04* (2013.01); *B08B 3/024* (2013.01); *B08B 3/10* (2013.01); *B08B 5/04* (2013.01); *B08B 2203/0223* (2013.01)

(58) Field of Classification Search
CPC .. A47K 7/04; B08B 3/024; B08B 3/10; B08B 5/04; B08B 2203/0223
See application file for complete search history.

(56) References Cited

U.S. PATENT DOCUMENTS 3,281,864 A * 11/1966 Linnehan ..... A61M 3/0208 4/537
6,468,235 B2 10/2002 Ito et al.
7,431,718 B2 10/2008 Ikadai

FOREIGN PATENT DOCUMENTS

EP 1474272 B1 11/2008
JP 2017099868 A * 6/2017 ..... A46B 13/008
KR 200395067 Y1 * 7/2005 ..... A47K 7/04
KR 100611875 B1 8/2006

OTHER PUBLICATIONS

Machine translation for KR-200395067 (Year: 2005).*
Machine translation for 2017099868 (Year: 2017).*

* cited by examiner

*Primary Examiner* — Erin F Bergner

(57) ABSTRACT

A method for cleansing a desired skin surface, and a device therefor, can include a base to house a jar for the cleansing liquid, a jar for the removed liquid and debris, a pump to deliver the cleansing liquid to a wand applicator, and a pump to suction the cleansing liquid and debris removed from the desired skin surface. The two pumps can be driven by separate motors to allow a user to separately control the amount of liquid dispensed and the magnitude of the suction force applied. The device can also include an infusion enhancer that assists in the opening of the pores of the desired skin surface or by tightening the desired skin surface. The device can further include a self-cleaning tip that allows a cleaning solution to be immediately recycled through the system into the jar for the removed liquid and debris.

17 Claims, 11 Drawing Sheets

ACTIVE FLOW FACIAL CLEANSER

FIELD OF THE INVENTION

The present invention pertains generally to facial cleansing machines. More specifically, the present invention pertains to at-home, facial hydrating and cleansing machines. The invention is particularly, but not exclusively, useful as an at-home, facial hydrating and cleansing machine with active flow and flow control.

BACKGROUND OF THE INVENTION

In the past, facial cleansing and microdermabrasion was only available to consumers at spas at an expensive price. A few at-home machines have been designed and sold on the market, but the machines are too abrasive for everyday use and did not use active flow, which allows for the amount of serum flowing through and out of the system to be changed according to preference.

The machines previously sold had one pump that would run the entire system and resulted in no flow control—if serum was used, the amount could not vary based on the user's preference and it was often too much serum or not enough. This has cost consumers a good deal of money to get the proper facial treatment by either being treated at a professional spa, buying different machines with different rates of flow, or causing damage or discomfort to their face in an attempt to hydrate and cleanse. With this consistent and higher frequency use, the tubing and other parts of the system could become dirty and clogged.

The present invention is an at-home, facial hydrating and cleansing machine that has active flow-control of serum separate from control of the suction employed by the system. Because the device is configured to be gentle, it is able to be used by the customer far more often than other facial machines. With the increased use, flow-control tips can increase the output of serum or decrease to the point of complete turnover of the serum through the tubing to the waste container such as a cleaning tip or configuration on the base to allow for an efficient cleaning process.

In view of the above, it can be an object of the present invention to provide independent flow of the serum to prevent the facial hydration and cleansing treatment from being dry, painful, or too abrasive. Yet another object of the present invention can be to provide a non-suction tip to prevent the system from allowing inadequate serum-face contact time for hydration and cleansing. Still another object of the present invention can be to provide flow-control directly to the consumer through a button-controlled valve to prevent the facial hydration and cleansing treatment from being dry, painful, or too abrasive. Another object of the present invention can be to provide a tip or configuration that controls the flow of serum or liquid and redirects it directly to the waste container for use in a cleaning mode.

SUMMARY OF THE INVENTION

A device for at-home, facial hydrating and cleansing with flow-control. In some embodiments, the device is created with a liquid pump in addition to the traditional air pump in order to force liquid through the system independent of the vacuum rate of the waste.

In other embodiments, there is a valve within the system that can be button-activated by the consumer to allow more liquid to flow through the system. In further embodiments, a non-suction tip can be used to prevent the system from sucking the liquid into the waste container without adequate serum-face contact time. In still other embodiments, a full-suction tip can be provided to prevent the discharge of any liquid other than into the waste container for maximum liquid-system contact and to allow localized suction therapy.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
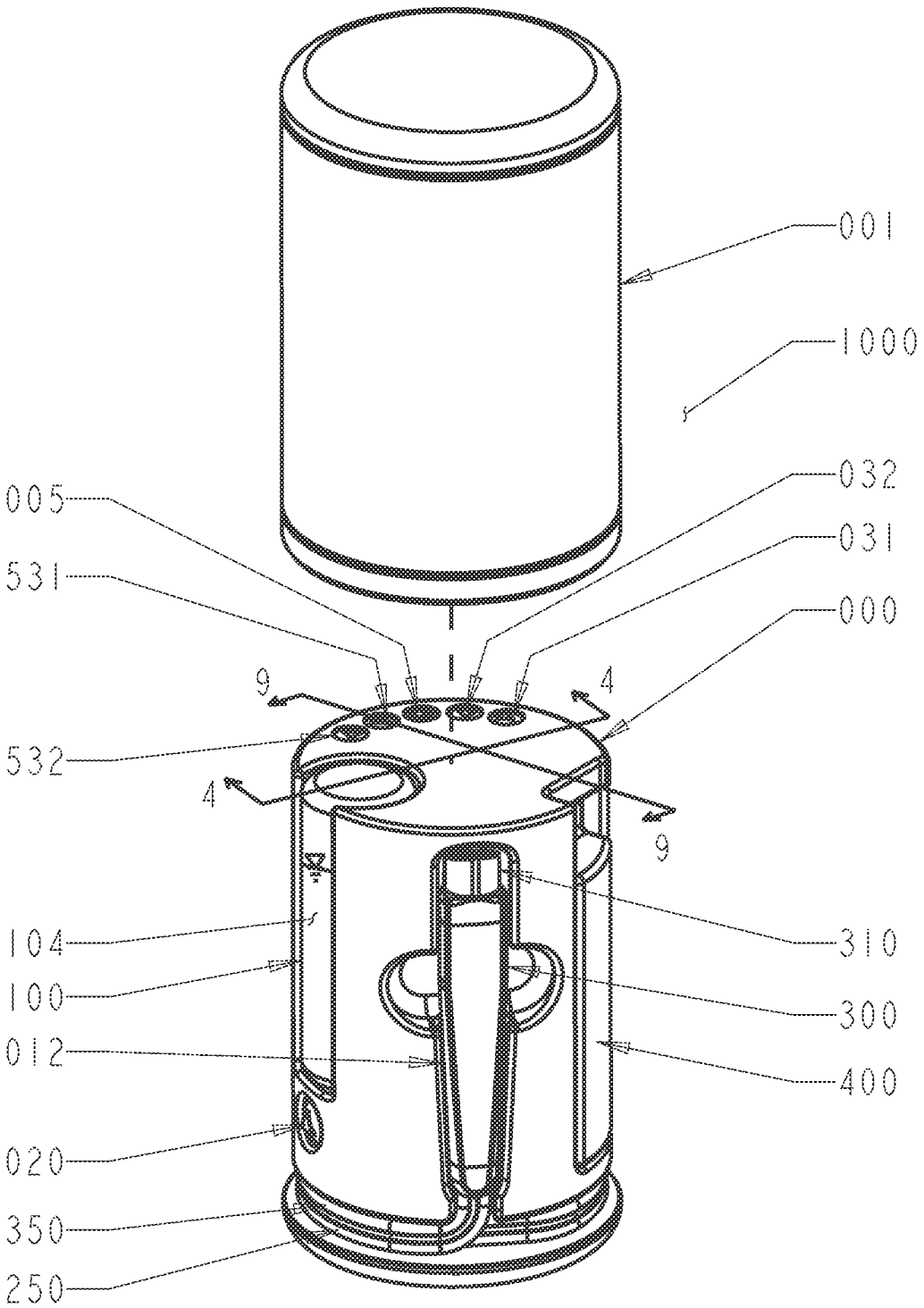
FIG. 1 can be a frontal elevational view of the system with the cover removed according to several embodiments of the present invention.

Referring now to the Figures, a device for mounting an object to be protected on a surface according to several embodiments of the present invention can be shown and generally designated by reference character 1000, as shown in FIG. 1. The base 000 houses the internal components of the system 1000. The base 000 can be a plastic housing with a cover 001 for aesthetics. The base 000 can be of a cylindrical shape about eight (8) inches tall with a diameter of four (4) inches, or of similar shape, size, or volume. The base 000 houses all components of the system 1000. The base 000 can have a quick release button 020, which can release a serum jar 100 from the base 000 and holds serum 104. The base 000 can have a power button 005, an increase flow button 031, a decrease flow button 032, an increase suction button 531, and a decrease suction button 532. The power button 005, the increase flow button 031, the decrease flow button 032, the increase suction button 531, and the decrease suction button 532 can be connected to a motherboard 600 by a bundle of wires 003 at a pin 603 (see FIG. 5). The base 000 can also house a junk jar 400, a wand 300, which has a tip 310, a liquid pump tubing 250, and an air pump tubing 350. The base 000 can be configured to hold the wand 300 in a wand slot 012. The wand slot 012 can retain the wand 300 due to gravity or by using a press fit or mechanical restraint.

Figure 2:
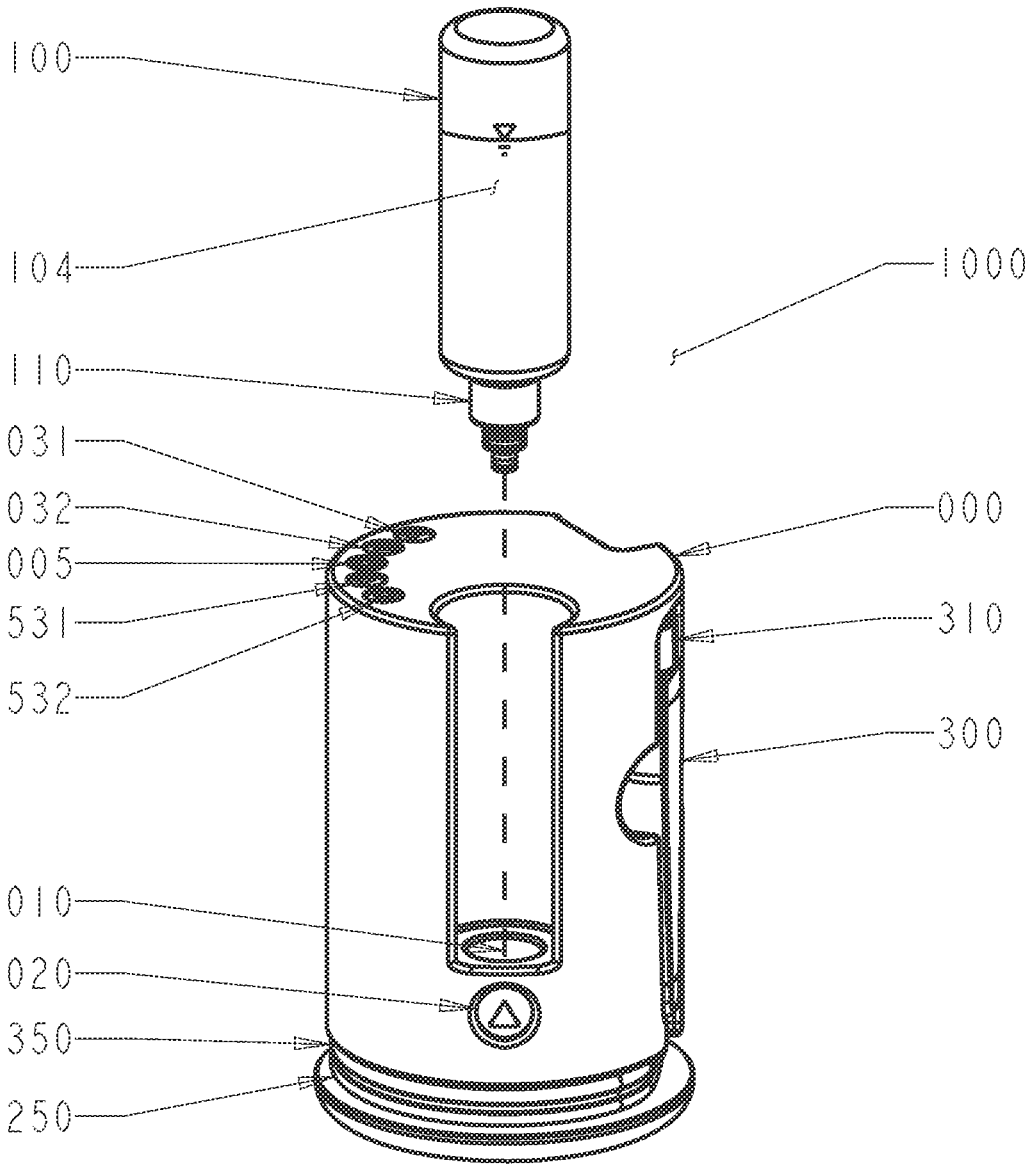
FIG. 2 can be a side elevational view of the device of FIG. 1 with the serum jar removed from the base.

Referring now to FIG. 2, the serum jar 100 can be inserted into the base 000 at a connection point 010 with a two-port connector 110. The serum jar 100 can be of a size to hold approximately two (2) ounces of serum 104. The serum jar 100 can be made of various materials such as plastic or glass and can be transparent, translucent, or opaque depending on the serum's 104 properties regarding light, UV, and others or based on cost efficiency.

Figure 3A:
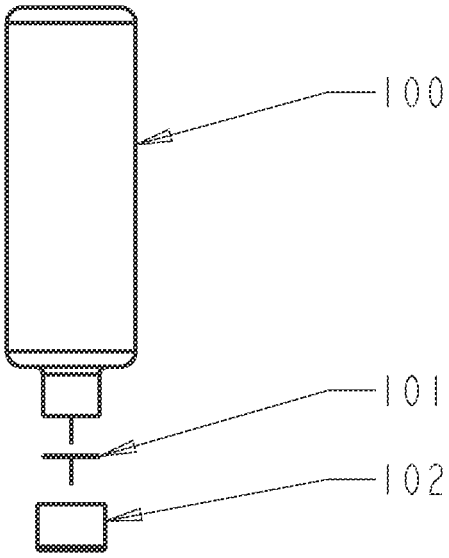
FIG. 3A can be an exploded side view of the serum jar from FIG. 2, which shows the manner in which one embodiment of the serum jar is sealed.
Figure 3B:
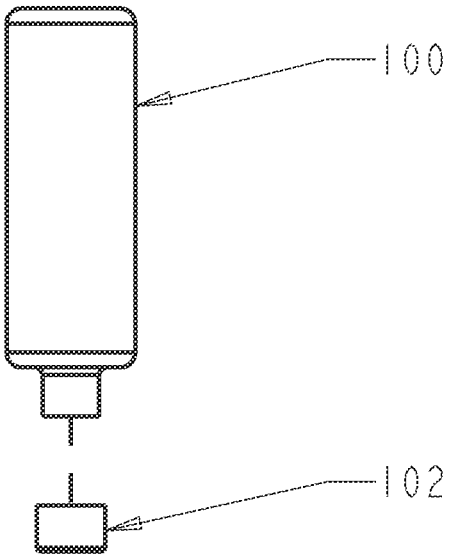
FIG. 3B can be an exploded side view of the serum jar from FIG. 2, which shows the manner in which a second embodiment of the serum jar is sealed.

The Serum jar 100 can be sealed with a cap 102, as shown in FIG. 3A, or a foil seal 101 and the cap 102, as shown in FIG. 3B for transportation and storage. Referring again to FIG. 2, to prevent leakage or spillage of the serum during installation, connection point 010 can be configured to pierce the foil seal 101 of the serum jar 100 (shown in FIGS. 3A and 3B), or the two-port connector 110 can be configured with a mechanical valve 103 that opens after installation of the serum jar 100 to the base 000.

Figure 4A:
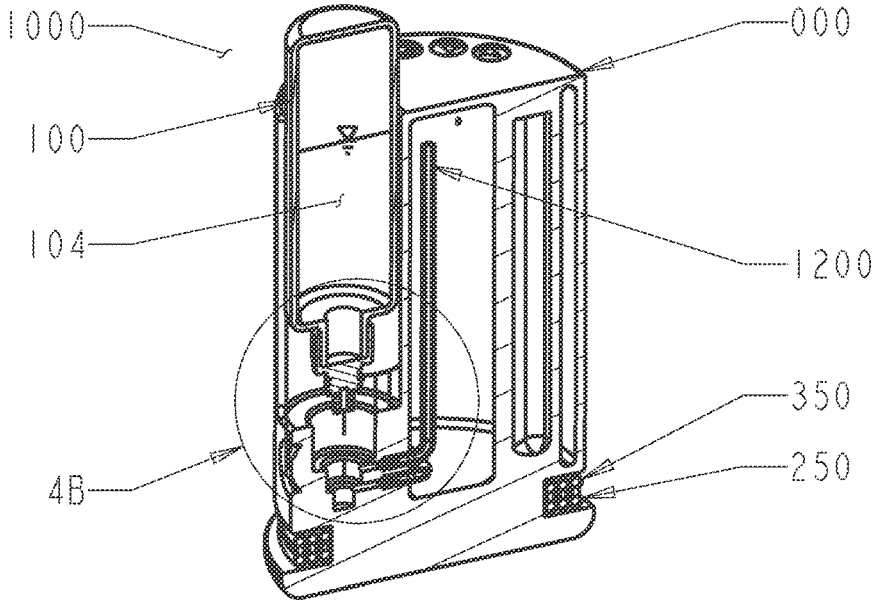
FIG. 4A can be a cross-sectional view of the device of FIG. 1 taken along line 4-4 in FIG. 1, which shows the manner in which one embodiment of the device is assembled.
Figure 4B:
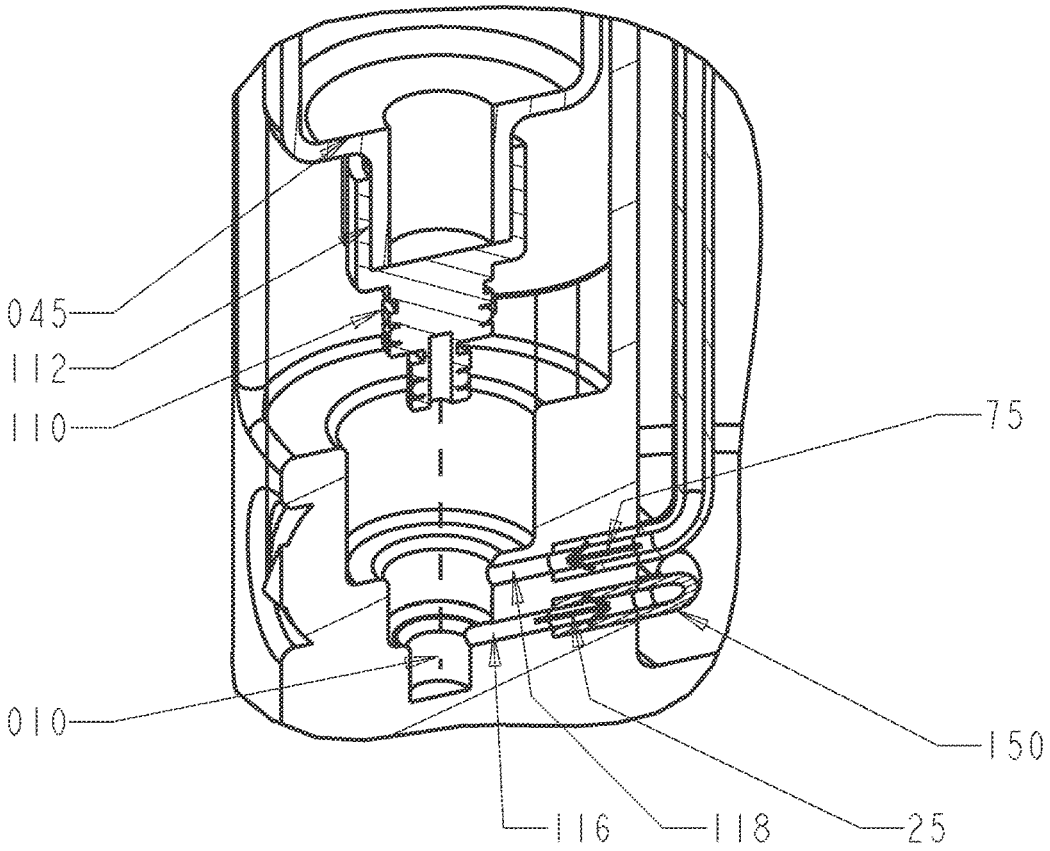
FIG. 4B can be a magnified view of the 4B area of FIG. 4A.

Referring now to FIG. 4B, to connect the serum jar 100 to the base 000 at the connection point 010, the two-port connector 110 can be used. The two-port connector 110 can attach to the serum jar 100 via an airtight interface 112, which can be a threaded, bonded, or quick connect interface. The connector 110 can be cleaned or sterilized and reused with multiple serum jars 100, which can be cleaned and reused as well. Also shown in FIG. 4B, connector 110 can have a port 116 which will allow the serum 104 to flow in the system 1000 in direction 25, while a port 118 of connector 110 will allow air 106 to flow in direction 75 into the serum jar 100 to balance the pressure within the serum jar 100. This can eliminate the opportunity of a vacuum and an unnecessary load being created and placed on the system 1000.

Figure 5:
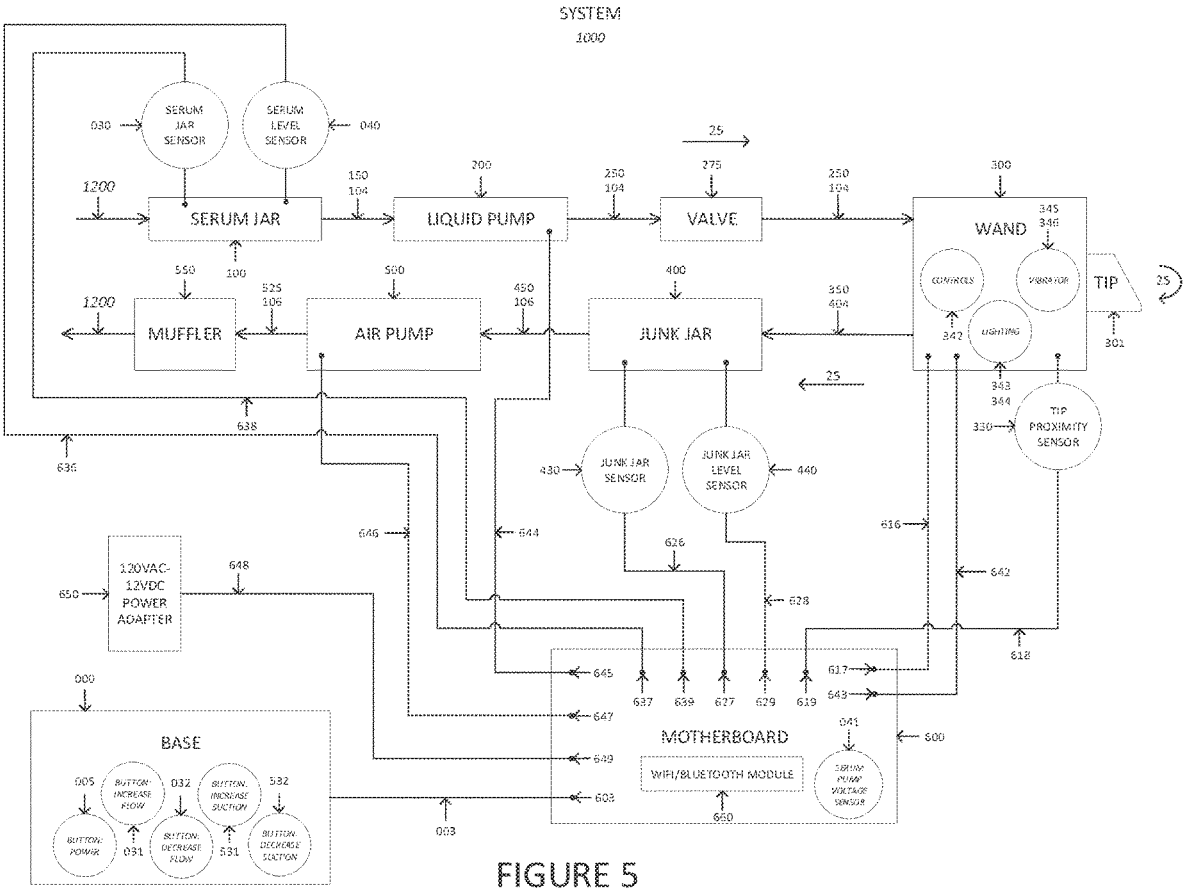
FIG. 5 can be a block diagram of the device showing the components and wiring according to several embodiments of the present invention.

As shown in FIG. 5, connection point 010 from FIG. 4B can be manufactured with a serum jar sensor 030. The serum jar sensor 030 can be connected to the motherboard 600 by a wire 638 at pin 639 to prevent using the system 1000 unless a serum jar 100 is fully and properly inserted into the base 000 at connection point 010.

Referring still to FIG. 5, the base 000 can also be configured with a serum level sensor 040 that can send a signal to the motherboard 600 through a wire 636 to pin 637 if the serum 104 drops below a certain level 045 (depicted in FIG. 4B) to prevent use of the system 1000 without an adequate amount of serum 104. Alternatively, a serum pump voltage sensor 041 can be installed which is on the motherboard 600, and if the voltage pulled by the liquid pump 200 increases to a level that indicates that there is no liquid being pumped by the liquid pump 200, the motherboard 600 can prevent current from being sent to the liquid pump 200 so as to protect the liquid pump The serum jar 100 can be connected to the liquid pump 200 by means of a serum tube 150. The liquid pump 200 can connect to a wand 300 by the liquid pump tubing 250 which can transport serum 104 to the wand 300. The liquid pump tubing 250 can have a valve 275 for flow control in line between the liquid pump 200 and the wand 300. The liquid pump 200 can operate at low voltage such as 12 VDC or less. The liquid pump 200 will receive power from the motherboard 600 through a wire 644 which connects to pin 645. The motherboard 600 can send different levels of voltage to the liquid pump 200 to change the amount of serum 104 that is pumped by the liquid pump 200. The level of voltage sent to the liquid pump 200 by the motherboard 600 can be increased with the increase flow button 031 or decreased with the decrease flow button 032 which are connected to the motherboard by the wire bundle 003 at the pin 603.

Still referring to FIG. 5, the wand 300 can be configured with a proximity sensor 330 to send a signal to the motherboard 600 through a wire 618 connected to the motherboard 600 at pin 619 when a desired surface is within range which allows the motherboard 600 to send voltage to the system 1000 or control how much voltage is sent. The wand 300 can also be configured to house controls for operation 342, lighting for treatment 343, indicator lighting 344, massage vibrators 345, and indicator vibrators 346.

The lighting for treatment 343 can be an LED, or light emitting diode, therapy, which is a skincare treatment that uses varying wavelengths of light, such as red and blue light. Red light can target oil glands to reduce cytokines, which cause inflammation and play a role in chronic acne. It can also boost blood flow while spurring the production of collagen and adenosine triphosphate (ATP), improving skin tone and texture. It can also give off infrared light, with a wavelength of 880 nm which can work in combination with red light, with a wavelength of 660 nm, to create a regenerating effect in aging skin. This light has a longer wavelength, enabling it to penetrate deeper into the skin than blue light.

Blue light therapy can penetrate the pores and eliminate bacteria by stimulating the production of oxygen radicals. While some bacteria are helpful, others promote oil production and other blemish-causing conditions. Blue light can activate chemicals inside these bacteria, which ruptures their outer walls, destroying the cell and their ability to form acne and other imperfections. Both wavelengths do so without damaging the skin.

The wand 300 is connected to a junk jar 400 by the air pump tubing 350 which transports serum 104 and debris 395 (shown in FIG. 8), which have combined to become a junk 404, removed from the desired surface to the junk jar 400.

In reference to FIG. 5 still, the base 000 can be configured with a junk jar sensor 430. The junk jar sensor 430 can be connected to the motherboard 600 by a wire 626 at a pin 627 to prevent using the system 1000 unless a junk jar 400 is fully and properly inserted into the base 000. The base 000 can also be configured with a junk level sensor 440 connected to the motherboard 600 by a wire 628 at a pin 629 that can send a signal to the motherboard 600 if the junk 404 reaches or exceeds a certain level 445 to prevent use of the system 1000 with too high of an amount of junk 404 (see FIG. 9), which could cause damage to the system 1000 by pulling liquid into an air pump 500.

Junk jar sensor 430 and junk level sensor 440 can, in another embodiment, be accomplished using a float and magnet system and a hall effect sensor. This can be done by placing a float on the lower end of a v-shaped element and a magnet at the upper end of the v-shaped element. At the point of the v-shaped element, the v-shaped element can be pivotably attached within the junk jar 400. In order for the motherboard 600 to send voltage to the air pump 500 which removes the junk 404, the magnet will need to be in readable range of a hall sensor placed within the base 000, which will occur when the junk jar 400 is connected to the base 000.

As the level of junk 404 within the junk jar 400 rises, the float with rise causing the magnet to lower. As the magnet lowers it will become closer to a hall effect sensor placed within the base 000 which will sense its proximity. Once the level of junk 404 reaches full inside the junk jar 400, the magnet will reach a certain proximity to the hall effect sensor which will send a signal to the motherboard 600 and cease voltage from being sent to the air pump 500.

The junk jar 400 is connected to the air pump 500 by an air tubing 450. The air pump 500 applies suction to the system 1000 through the air tubing 450. The air pump 500 can operate at low voltage such as 12 VDC or less. The air pump 500 will receive power from the motherboard 600 through a wire 646 connected at a pin 647. The motherboard 600 can send different levels of voltage to the air pump 500 to change the amount of suction that is applied to the desired surface. The level of voltage sent to the air pump 500 by the motherboard 600 can be increased with the increase suction button 531 or decreased with the decrease suction button 532 which are connected to the motherboard by the wire bundle 003 at the pin 603.

The air pump 500 can connect to a muffler 550 by means of tubing 525. The muffler 550 can decrease the sound of the exhaust of the air pump 500 and the system 1000 in general. The muffler 550 exhausts to ambient air 1200 within the base 000.

Referring still to FIG. 5, the motherboard 600 can receive direct current power from a power adapter 650 through a wire 648 connected to the motherboard 600 at pin 649. The power adapter 650 can connect to 120V alternating current found in a residential electrical system by the power adapter 650. The motherboard 600 can send power to the wand 300 by a wire 642 connected to the motherboard 600 at pin 643.

Lastly, the motherboard 600 can be manufactured with a Wi-Fi/Bluetooth module 660 that can connect to a Wi-Fi signal or Bluetooth device.

Figure 6:
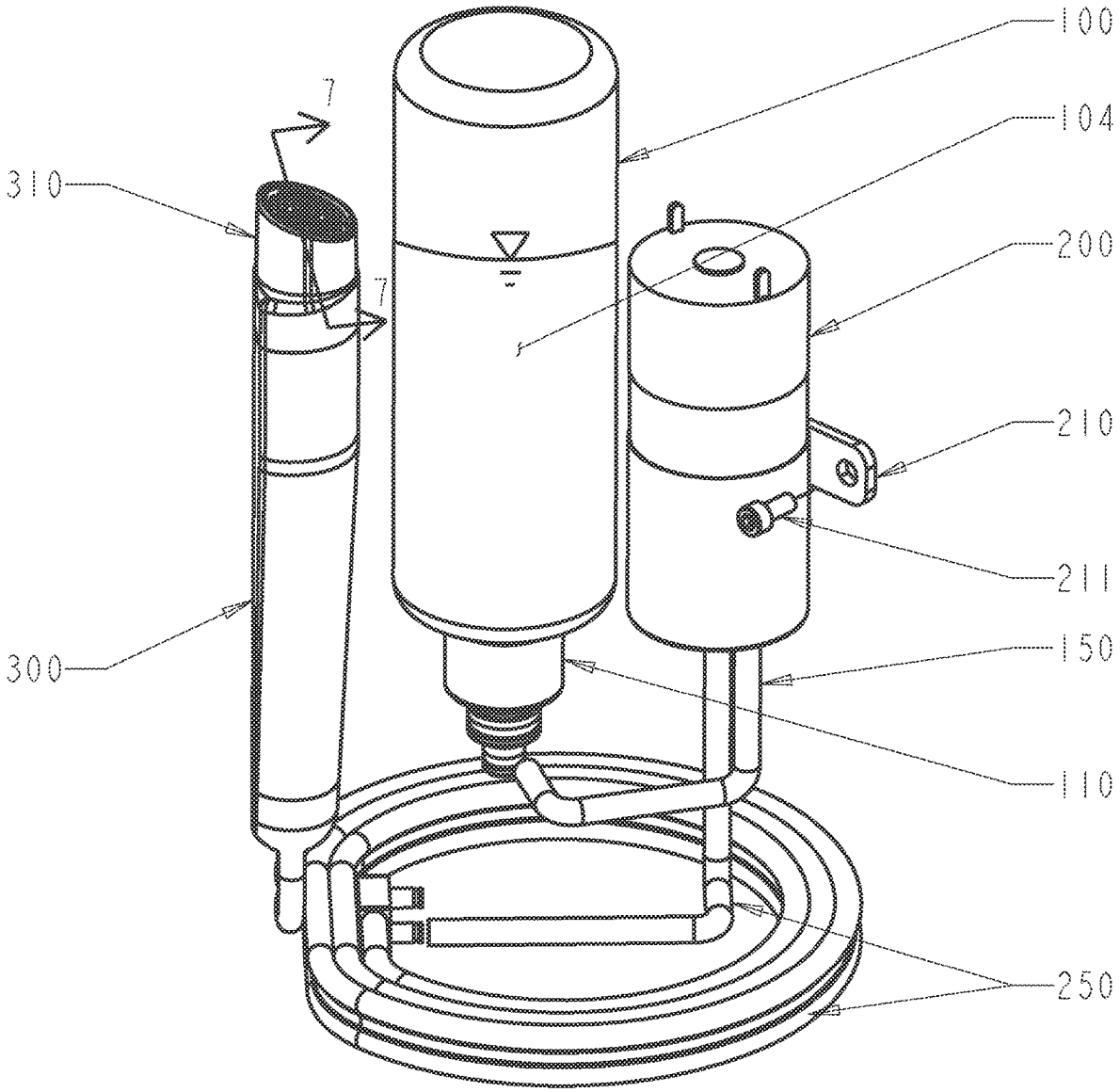
FIG. 6 can be a side elevational view of the liquid side of the device of FIG. 1 according to several embodiments of the present invention.

As shown in FIG. 6, a coupling 210 will secure the liquid pump 200 using a fastener screw 211, which will attach the liquid pump 200 to the base 000. FIG. 6 shows the liquid or serum delivery part of the system 1000, meaning all of the components that contribute to delivery of the serum 104 or cleansing liquid to the wand 300 and eventually to the desired skin surface to be cleansed in some embodiments.

Figure 7A:
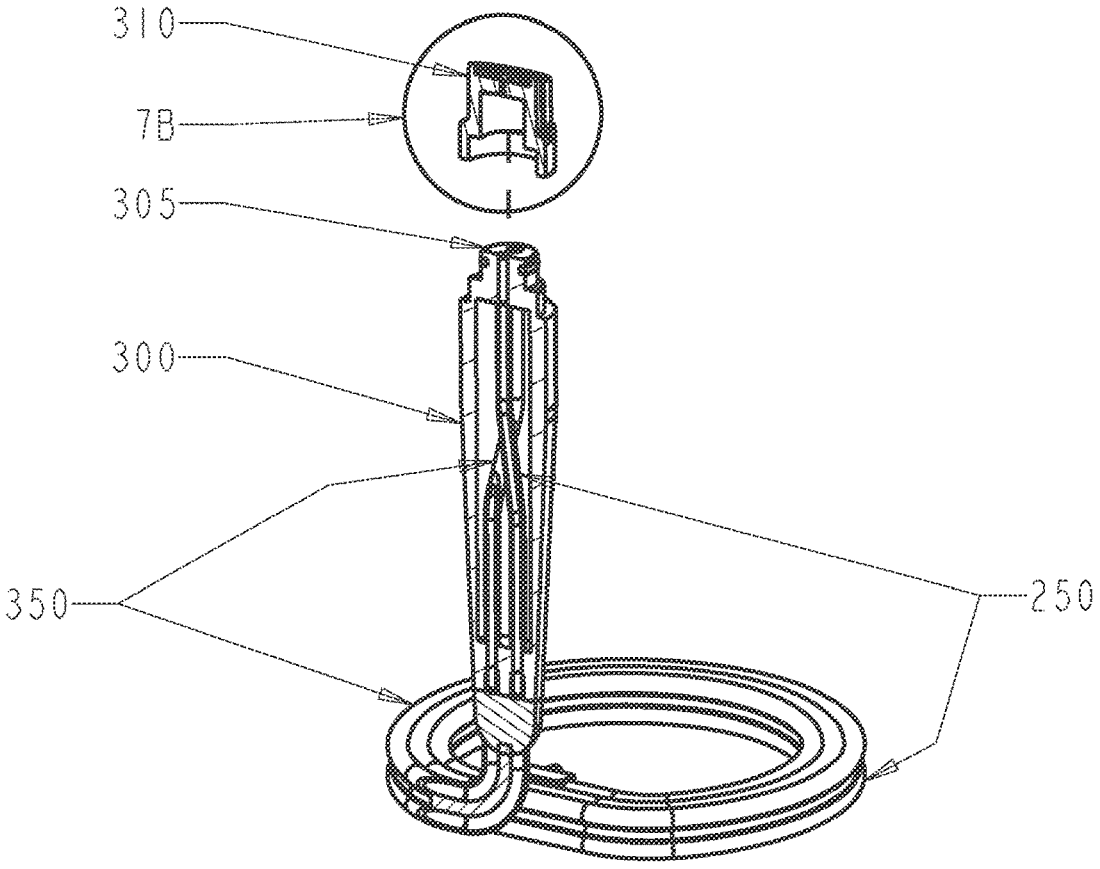
FIG. 7A can be a cross-sectional view of the wand of FIG. 6 taken along line 7-7 in FIG. 6, which shows the manner in which the wand can be connected to the tubing of the device according to several embodiments of the present invention.
Figure 7B:
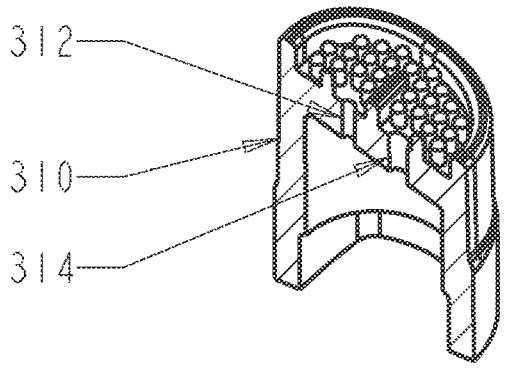
FIG. 7B can be a magnified view of the 7B area of FIG. 7A.

As shown in FIG. 7A, the liquid pump tubing 250 extends to a distal end 305 of the wand 300. The tip 310 can be connected to the distal end 305 of the wand 300 to better apply the suction of the system 1000 to the desired surface. The liquid pump tubing 250 can deliver the serum 104 through a hole 312 in the tip 310 onto the desired surface, as shown in FIG. 7B. Tip 310 can also have a second hole 314 that leads to the air pump tubing 350 which has a suction applied by the system 1000. Serum 104 and debris 395, such as dirt, can combine to become the junk 404. The junk 404 is removed from the desired surface through the hole 314 and into the air pump tubing 350 and eventually to the junk jar 400.

Figure 8:
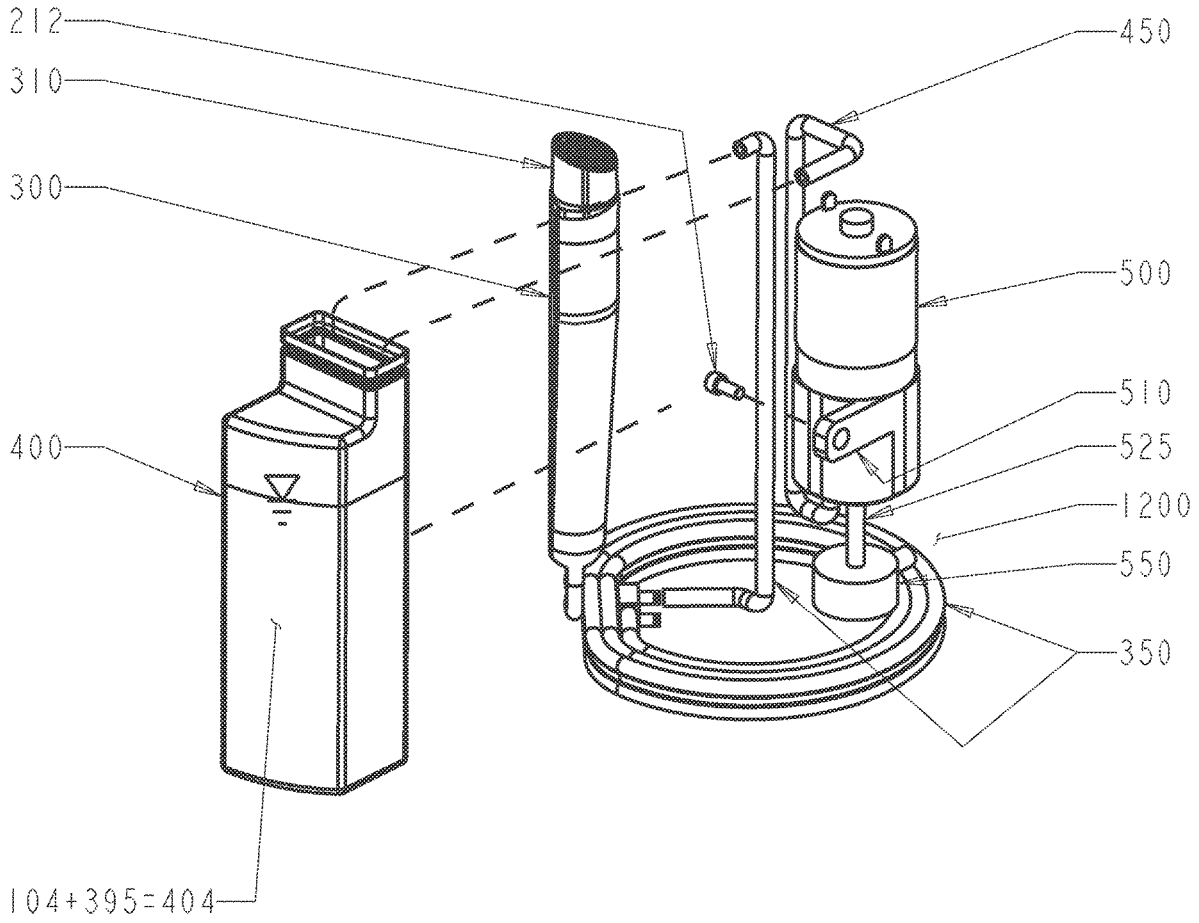
FIG. 8 can be a side elevational view of the of the junk side of the device of FIG. 1 according to several embodiments of the present invention.

Referring now to FIG. 8, a bracket 510 and a second fastener screw 212 will secure the air pump 500 to base 000. FIG. 8 shows the disposal or junk part of the system 1000, meaning all of the components that contribute to removal of debris 395 and used serum 104 or cleansing liquid or delivery of the junk 404 from the wand 300 to the junk jar 400 according to several embodiments of the present invention.

Figure 9:
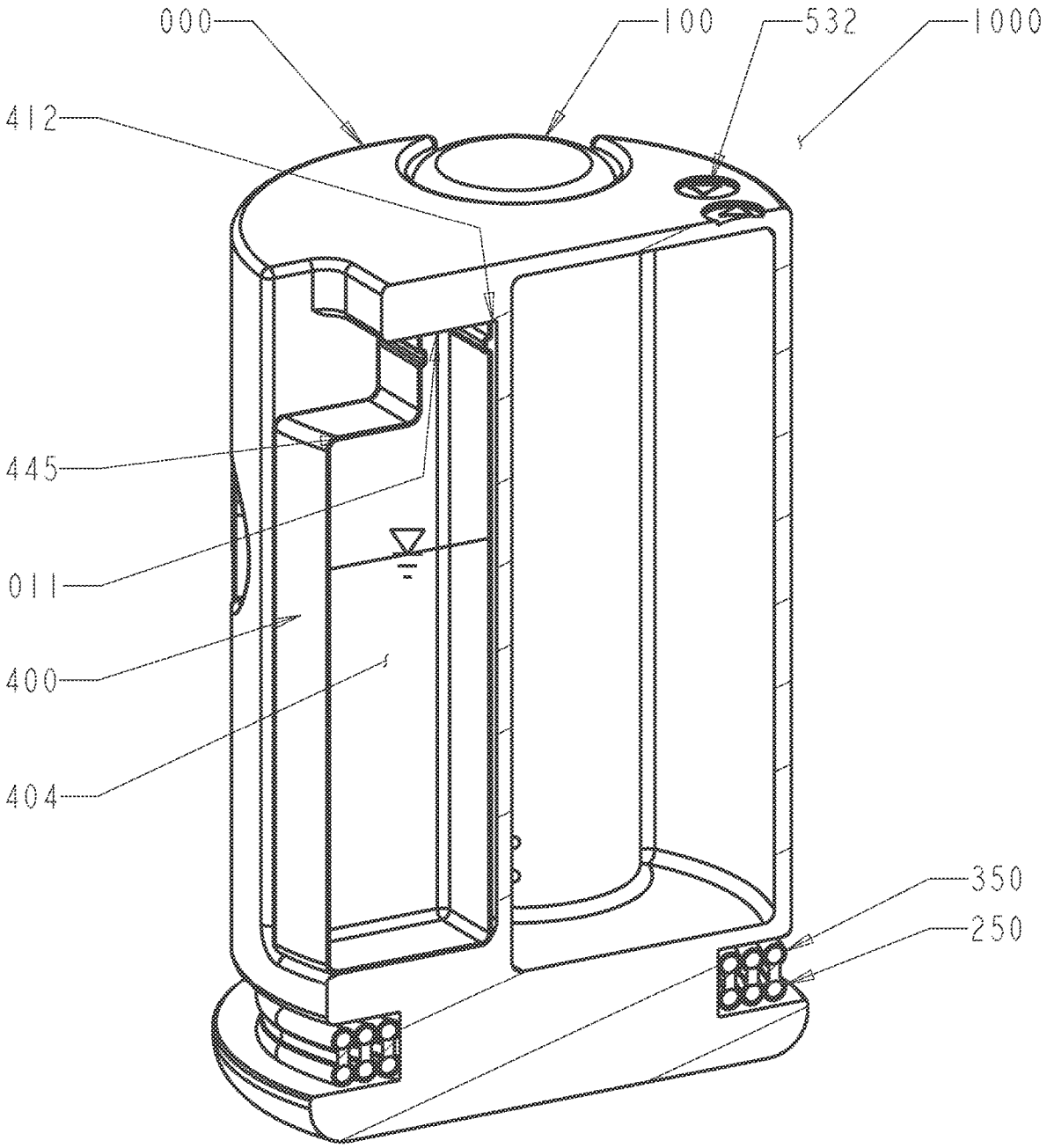
FIG. 9 can be a cross-sectional view of the device of FIG. 1 taken along line 9-9 in FIG. 1, which shows the manner in which one embodiment of the device is assembled.

Referring to FIG. 9 now, the base 000 can have a connection point 011 where the junk jar 400 can connect to the base 000 via an airtight interface 412, which can be a threaded, bonded, or quick connect interface.

Figure 10:
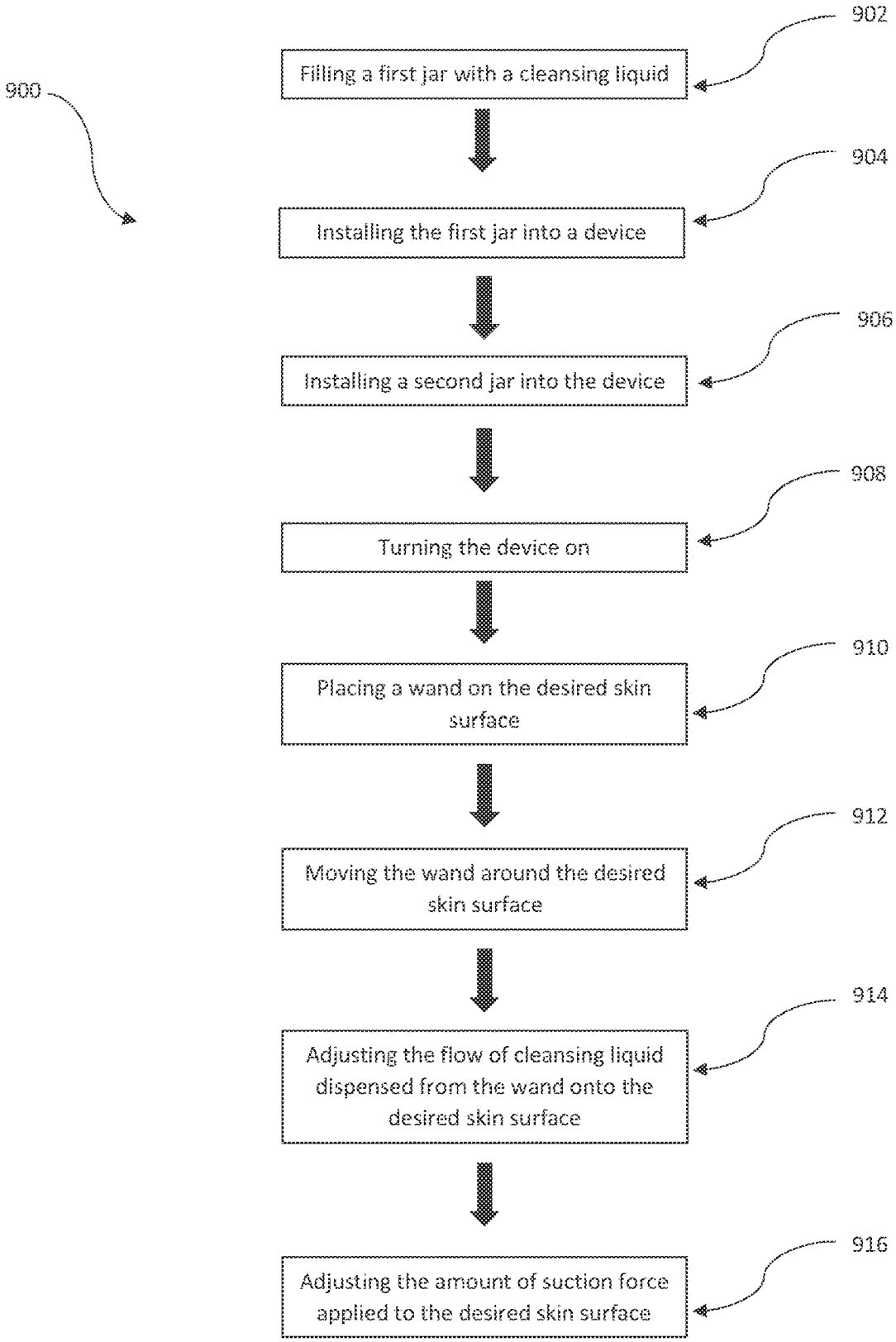
FIG. 10 can be a block diagram that can be illustrative of steps that can be taken to practice the methods according to several embodiments of the present invention.

Referring now to FIG. 10, a block diagram 900 is shown that can be illustrative of steps that can be taken to practice the methods of the invention according to several embodiments. The methods can be accomplished using the structure and cooperation of structure cited above. As shown in FIG. 7, the steps taken can include the step of filling a first jar with a cleansing liquid, as illustrated by step 902. The methods can further include the step of installing the first jar into a device, as shown by step 904. Another step can be installing a second jar into the device, as shown in step 906 in FIG. 7. Additionally, the methods can include the step of turning the device on, as illustrated by step 908. The methods can further include the step of placing a wand 300 on the desired skin surface, as shown by step 910. Step 912 can be moving the wand 300 around the desired skin surface. Another step can be adjusting the flow of cleansing liquid dispensed from the wand 300 onto the desired skin surface, as shown by step 914. Step 916 can be adjusting the amount of suction force applied to the desired skin surface.

Figure 11A:
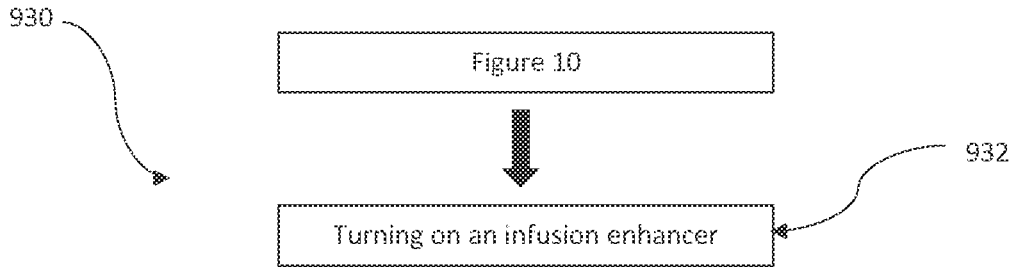
FIG. 11A can be a block diagram that can be illustrative of steps that can be taken to practice the methods according to an alternative embodiment of the present invention.
Figure 11B:
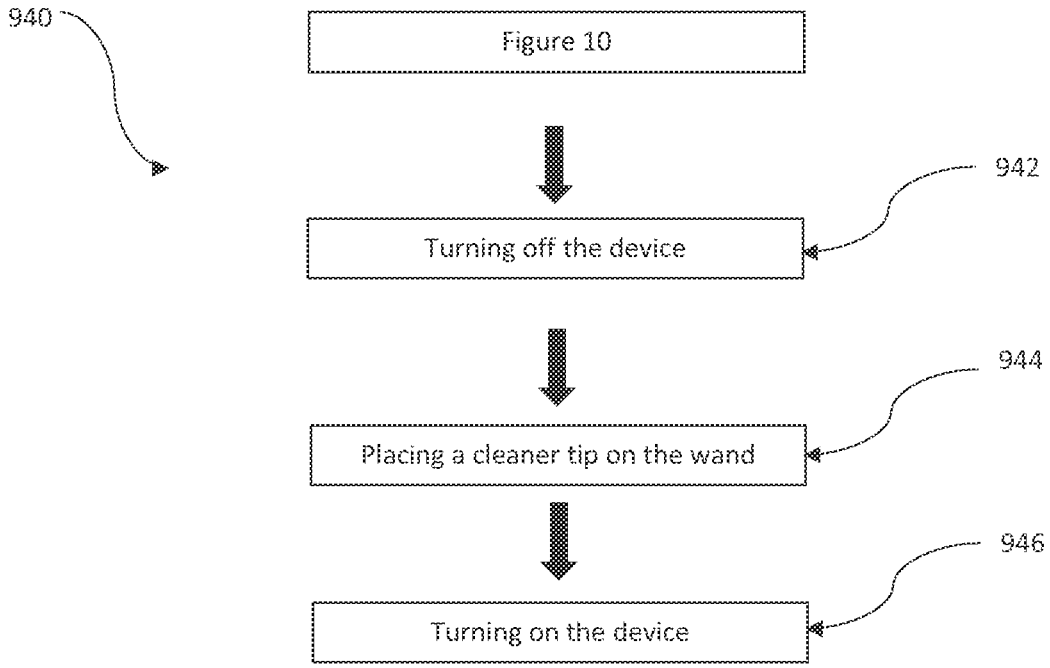
FIG. 11B can be a block diagram that can be illustrative of steps that can be taken to practice the methods according to yet another alternative embodiment of the present invention.

Another embodiment can include the step of turning on an infusion enhancer, as shown in step 932 of block diagram 930 in FIG. 11A, that increases the efficiency with which the serum infuses into the desired surface. Alternatively, as shown in block diagram 940 of FIG. 11B, another embodiment can include the step of turning off the device, as shown in step 942. The method can further include the step of placing a cleaner tip on the wand 300, as shown in step 944. Lastly, the method can include the step of turning on the device, as shown in step 946 of FIG. 11B.

During the self-cleaning cycle of step 946, the tip can be a sealed tip placed on the wand 300 during step 944 which send cleansing liquid directly from the first hole 312 back into the second hole 314 and through the rest of the system 1000. Both the liquid pump 200 and the air pump 500 can be in operation to ensure the best cleansing of the system 1000. In an alternative embodiment, the base 000 can be configured to hold the wand 300 and directly connect the first hold 312 to the second hold 314 causing the cleansing liquid to run directly through the system 1000 while cleaning it without expulsion out of the wand 300.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of any ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Several embodiments of this invention are described herein, including the best mode known to the inventors for carrying out the invention. Variation of those several embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variation thereof is encompassed by the invention unless otherwise indicated herein or otherwise clearly contradicted by context.

What is claimed is:

1. A device for cleansing a desired skin surface, said device comprising:

a base for housing components of the device, the components including:

a first jar for storing a cleansing liquid;

a wand for dispensing the cleansing liquid onto the desired skin surface and suction it off with debris pulled from the desired skin surface;

a first pump to pump the cleansing liquid from the jar to the wand;

a second jar for storing junk which is the cleansing liquid combined with the debris;

a second pump for pumping the junk from the wand to the second jar;

a motherboard to control the voltage delivered to the first pump and the second pump;

wherein the first pump and second pump are driven by separate motors to allow power of each of the first pump and second pump to be set at separate levels, the base is configured with a first jar sensor to prevent usage of the device without the cleansing liquid in the first jar, the base is configured with a second jar sensor to prevent usage of the device without the second jar in place to store the junk removed, the device includes a cleansing liquid level sensor, the device includes a junk level sensor, the device is configured to allow a used to alters the amount of cleansing liquid dispensed out of the wand by controlling the voltage delivered to the first pump, the device is configured to allow a used to alters the amount of suction force applied by the wand by controlling the voltage delivered to the second pump, and the wand houses an infusion enhancer configured to increase the amount of cleansing liquid injected into the skin surface.

2. The device of claim 1, wherein the wand houses a proximity sensor configured to prevent expulsion of the cleansing liquid until within a certain proximity of the desired skin surface.

3. The device of claim 1, wherein the base, includes a first sensor to determine when the wand is properly inserted into the base, and is configured to redirects the cleansing liquid to the second jar without expulsion from the wand in order to clean the device.

4. The device of claim 3, wherein the first sensor includes a magnet inside the wand and a magnetic position sensor in the base configured to relays the position of the magnet to the motherboard to allow the motherboard to prevent usage of the device in a self-cleaning cycle if the wand is not property inserted into the base.

5. The device of claim 1, wherein the cleansing liquid level sensor includes a buoyant float with an internal magnet inside the first jar and a magnetic position sensor in the base configured to relays the position of the buoyant float to the motherboard to allow the motherboard to prevent voltage from being delivered to the first pump when the level indicates that there is not enough cleansing liquid remaining in the first jar.

6. The device of claim 1, wherein the cleansing liquid level sensor is a voltage sensor connected to the first pump configured to prevent voltage from being delivered to the first pump once the voltage surpasses a certain amount that indicates that there is not enough cleansing liquid remaining in the first jar.

7. The device of claim 1, wherein the junk level sensor includes a buoyant float with an internal magnet inside the second jar and a magnetic position sensor in the base configured to relays the position of the buoyant float to the motherboard to allow the motherboard to prevent voltage from being delivered to the second pump when the level indicates that there is too much junk in the second jar.

8. The device of claim 1, wherein the motherboard contains a Wi-Fi and Bluetooth module to allow the device to connect to Wi-Fi and other devices.

9. The device of claim 1, wherein the infusion enhancer is a vibrator configured to assists in the opening of the pores to allow more infusion of the cleansing liquid.

10. The device of claim 1, wherein the infusion enhancer is a red LED light configured to assists in the opening of the pores to allow more infusion of the cleansing liquid.

11. The device of claim 1, wherein the infusion enhancer is a blue LED light configured to assists in the opening of the pores to allow more infusion of the cleansing liquid.

12. The device of claim 1, wherein the wand includes a detachable tip that allows for a cleaning cycle by immediately recycling a device cleansing liquid into the second jar through the device.

13. A method for cleansing a desired skin surface, said method comprising the steps of:

A) providing the device of claim 1

B) Filling the first jar with the cleansing liquid;

C) Installing the first jar into the device;

D) Installing the second jar into the device;

E) Turning the device on;

F) Placing the wand on the desired skin surface;

G) Moving the wand around the desired skin surface;

H) Adjusting the flow of cleansing liquid dispensed from the wand onto the desired skin surface; and I) Adjusting the amount of suction force applied to the desired skin surface.

14. The method of claim 13, wherein said adjustment of the flow of cleansing liquid from step H is accomplished by a user increasing or decreasing voltage supplied to the first pump with the use of an increase flow button and a decrease flow button.

15. The method of claim 13, wherein said adjustment of the amount of suction force from step I is accomplished by a user increasing or decreasing voltage supplied to the second pump with the use of an increase suction button and a decrease suction button.

16. The method of claim 13, further comprising the step of: J) Turning on the infusion enhancer.

17. The method of claim 13, further comprising the steps of: J) Turning off the device; K) Placing a new tip on the wand; and L) Turning on the device.

* * * * *